US006057281A

United States Patent [19]

Stamm

[11] Patent Number: 6,057,281

[45] Date of Patent: May 2, 2000

[54] TABLETED HOUSEHOLD CLEANER COMPRISING CARBOXYLIC ACID, (BI) CARBONATE AND POLYVINYL ALCOHOL

[75] Inventor: Charles L. Stamm, Kentwood, Mich.

[73] Assignee: Amway Corporation, Ada, Mich.

[21] Appl. No.: 09/250,371

[22] Filed: Feb. 16, 1999

Related U.S. Application Data

[63] Continuation-in-part of application No. 08/658,657, Jun. 5, 1996, Pat. No. 5,885,949.

[51] Int. Cl.[7] ..... C11D 7/26; C11D 7/12; C11D 3/37; C11D 1/90

[52] U.S. Cl. ..... 510/446; 510/117; 510/218; 510/224; 510/298; 510/477; 510/478; 510/490; 510/509; 510/533

[58] Field of Search ..... 510/446, 224, 510/180, 117, 298, 477, 478, 509, 533, 214, 218, 490; 252/FOR 205, FOR 236, FOR 241

[56] References Cited

U.S. PATENT DOCUMENTS

| | | | |
|---|---|---|---|
| 2,854,377 | 9/1958 | Elias | 424/44 |
| 3,607,759 | 9/1971 | Barth | 510/100 |
| 3,761,415 | 9/1973 | Gould | 8/137 |
| 4,124,522 | 11/1978 | Barton | 134/42 |
| 4,180,467 | 12/1979 | Barth | 510/117 |
| 4,181,621 | 1/1980 | Raaf et al. | 134/30 |
| 4,210,550 | 7/1980 | Cornelissens | 510/349 |
| 4,234,442 | 11/1980 | Cornelissens | 510/277 |
| 4,252,664 | 2/1981 | Inamorato | 510/319 |
| 4,269,723 | 5/1981 | Barford et al. | 510/192 |
| 4,405,486 | 9/1983 | Eoga | 252/186.31 |
| 4,409,118 | 10/1983 | Eoga | 510/117 |
| 4,417,993 | 11/1983 | Gergely | 510/117 |
| 4,568,517 | 2/1986 | Kaspar et al. | 42/30 |
| 4,619,710 | 10/1986 | Kuenn et al. | 134/22.17 |
| 4,678,661 | 7/1987 | Gergely et al. | 424/44 |
| 4,683,072 | 7/1987 | Holdt et al. | 510/192 |
| 4,879,105 | 11/1989 | Yorozu | 424/44 |
| 5,015,408 | 5/1991 | Reuss | 510/100 |
| 5,133,892 | 7/1992 | Chun et al. | 510/102 |
| 5,141,666 | 8/1992 | Yorozu et al. | 510/102 |
| 5,198,144 | 3/1993 | Ichii et al. | 510/101 |
| 5,306,439 | 4/1994 | Lockhart | 510/254 |
| 5,360,567 | 11/1994 | Fry et al. | 510/298 |
| 5,407,594 | 4/1995 | Fry et al. | 510/439 |
| 5,431,841 | 7/1995 | Lockhart | 510/109 |
| 5,885,949 | 3/1999 | Stamm | 510/180 |

FOREIGN PATENT DOCUMENTS

| | | |
|---|---|---|
| 61-207322 | 9/1986 | Japan . |
| 1-172319 | 7/1989 | Japan . |
| 989683 | 4/1965 | United Kingdom . |
| 87/02052 | 4/1987 | WIPO . |
| 97/46655 | 12/1997 | WIPO . |

*Primary Examiner*—Yogendra Gupta
*Assistant Examiner*—Christine Ingersoll
*Attorney, Agent, or Firm*—Brinks Hofer Gilson & Lione

[57] ABSTRACT

A tableted household cleaning composition for cleaning glass and other hard surfaces and methods for making and using the same are disclosed. The cleaning composition is in tablet form and includes an acidic component selected from the group consisting of carboxylic acids, their salts and mixtures thereof; a basic component selected from the group consisting of alkali metal carbonates, alkali metal bicarbonates and mixtures thereof; and polyvinyl alcohol.

1 Claim, No Drawings

TABLETED HOUSEHOLD CLEANER COMPRISING CARBOXYLIC ACID, (BI) CARBONATE AND POLYVINYL ALCOHOL

This is a continuation-in-part of U.S. patent application Ser. No. 08/658,657, filed on Jun. 5, 1996, now U.S. Pat. No. 5,885,949.

BACKGROUND OF THE INVENTION

The present invention relates to household cleaning compositions and, in particular, to household cleaning compositions in tableted form for use in cleaning glass and other hard surfaces.

Liquid and powdered products for cleaning glass and other hard surfaces are known in the art and are available in the marketplace. The liquid cleaning products generally contain water, thus making them heavy. Similarly, powdered products generally have a high-bulk capacity, which also results in a bulky product. Moreover, liquid and powdered cleaning products require a great deal of storage space.

Cleaning compositions in tablet form, like that of the present invention, have several advantages over such liquid and powdered products. Because they are compressed and contain no water, tablets are lightweight and have a low-bulk capacity. Their small size makes for more economical shipping and storage.

Surprisingly, it has been found that a household cleaning composition that effectively cleans glass and other hard surfaces can be prepared by combining an acidic component, a basic component and polyvinyl alcohol in a tablet. The polyvinyl alcohol provides a reduction in surface tension, so as to allow for easier wiping, and stabilizes the tableted cleaner. The tableted cleaner of the present invention dissolves quickly, resulting in a product with little or no streaking.

SUMMARY OF THE INVENTION

The present invention is directed toward household cleaning compositions in tablet form suitable for cleaning hard surfaces, especially glass. The present invention also relates to a method of using a cleaning tablet by dissolving the tablet in a liquid.

The tableted household cleaner of the present invention comprises an acidic component selected from the group consisting of carboxylic acids, their salts and mixtures thereof; a basic component selected from the group consisting of alkali metal carbonates, bicarbonates and mixtures thereof, and polyvinyl alcohol. Surfactant may also be present in the tableted composition.

In another embodiment, the present invention is a household cleaner in tablet form consisting essentially of disodium citrate, potassium bicarbonate and polyvinyl alcohol. According to a preferred embodiment, the tableted household cleaner consists of disodium citrate, potassium bicarbonate, polyvinyl alcohol and a 95:5 mixture of potassium bicarbonate and surfactant. In this embodiment, the preferred surfactant is an anionic surfactant, particularly, the salt of an alkyl sulfate.

The tableted household cleaner of the present invention is advantageous because it is compact and small in size. Because it is not in solution form, the tableted cleaner is lightweight and has a low-bulk capacity. The compactness of the tableted household cleaner of the present invention facilitates cost-effective shipping and storage. Additionally, the effervescence effect of the tableted cleaner assists in quick dissolution of the tablet in water, which then results in a cleaning product having minimal streaking.

In another embodiment, the present invention includes a method of making a tableted household cleaner that includes mixing the components to form a mixture and shaping the mixture into tablet form. In yet another embodiment, the present invention includes a method of using a tableted household cleaner that involves dissolving the tablet in a suitable amount of water to form a cleaning solution.

It is noted that, unless otherwise stated, all percentages given in this specification and the appended claims refer to percentages by weight of the total composition.

DETAILED DESCRIPTION OF THE PREFERRED EMBODIMENTS

The present invention relates to a cleaning composition in tablet form that is used for cleaning glass and other hard surfaces. Generally, the tableted cleaner includes a compressed block of an acidic component selected from the group consisting of carboxylic acids, their salts and mixtures thereof, a basic component selected from the group consisting of carbonates, bicarbonates and mixtures thereof, and polyvinyl alcohol. A minor amount of surfactant may also be present in the tablet.

The acidic component useful in the tableted household cleaner of the present invention is selected from the group consisting of a carboxylic acid, its salt and mixtures thereof The carboxylic acid can be a mono- or poly-carboxylic acid. Preferably, the carboxylic acid is one having up to 4 carbon atoms and is selected from the group consisting of acetic, citric, formic, propionic, malic and butyric acids and their homologs. The salt form is preferred over the acid form because a composition with a more neutral pH is safer to use. Thus, in accordance with a preferred embodiment, an alkali metal, preferably sodium, salt of a carboxylic acid is used. The sodium citrate may be mono-, di- or trisodium citrate with disodium citrate most preferred.

The carboxylic acid, its salt or mixtures thereof is preferably present in an amount ranging from about 20% to about 80%, more preferably from about 40% to about 75% and most preferably between about 60% and about 70%. In accordance with the most preferred embodiment, the carboxylic acid or alkali metal salt is present at a level of about 65%.

The basic component is selected from the group consisting of carbonates, bicarbonates and mixtures thereof. Preferably, any alkali metal carbonate, bicarbonate or mixtures thereof may be used in the tableted household cleaner of the present invention. Because of its higher solubility in water, potassium bicarbonate is most preferred. The basic component is preferably present in an amount between about 10% to about 50%. More preferably, the basic component ranges in an amount from about 20% to about 40% and most preferably between about 25% and about 30%. In accordance with the preferred embodiment, the basic component is present at a level of about 28%.

The acidic and basic components are preferably included in amounts to achieve rapid, complete solubility of the tablet. Consequently, in the preferred embodiment the molar ratio of acid to base ranges from about 1.0:2.0 to about 1.0:2.6. Any larger of a ratio would result in a slower dissolution time, i.e., greater than about 2 minutes. The preferred ratio of acid to base is about 1:2.3.

The combination of acidic and basic components should preferably comprise about 50% of the weight of the tablet. More preferably, the acidic and basic components comprise at least 75% of the weight of the tablet and most preferably, at least 90% of the weight of the tablet.

The third component of the tableted household cleaner is polyvinyl alcohol. Polyvinyl alcohol acts as a lubricant when rubbing the cleaning product of the present invention against a hard surface. In other words, the use of polyvinyl alcohol results in a product that aids in scrubbing with less foam than do other hard surface cleaners. The polyvinyl alcohol also imparts a good shine on polished metal surfaces such as chrome.

The polyvinyl alcohol suitable for use in the present invention preferably has a percent hydrolysis between about 85% and about 95% such that the polyvinyl alcohol is soluble in water at an ambient temperature. Any other percent hydrolysis requires heating and mixing in order to dissolve the polyvinyl alcohol. The polyvinyl alcohol is preferably present in the tableted household cleaner in an amount up to about 15%. More preferably, the amount of polyvinyl alcohol present ranges from about 2% to about 10%. Most preferably, the polyvinyl alcohol is present in an amount between about 3% and about 7%. According to a preferred embodiment, the tableted household cleaner of the present invention contains about 5% polyvinyl alcohol.

In a preferred embodiment of the present invention, the tableted household cleaner also includes a surfactant. The surfactant may be added to the other ingredients alone or as part of a mixture with the basic component where the ratio of the basic component to surfactant is preferably 95:5.

The surfactant used in the present invention is selected from the group consisting of amphoteric, anionic and nonionic surfactants and mixtures thereof The nonionic surfactants may be straight-chain or branched and are preferably ethoxylated for increased water solubility. Nonionic surfactants are well known in the detergency art. They may be included in the compositions of the present invention together with the other components defined hereinbefore. Nonlimiting examples of suitable nonionic surfactants which may be used in the present invention are as follows:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

(2) The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of inyristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms).

(3) The condensation products of ethylene oxide with a hydrophobic base formed by the condensation of propylene oxide with propylene glycol. The hydrophobic portion of these compounds has a molecular weight of from about 1500 to 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide.

(4) The condensation of ethylene oxide with the product resulting from the reaction of propylene oxide and ethylenediamine. The hydrophobic moiety of these products consists of the reaction product of ethylenediamine and excess propylene oxide, the moiety having a molecular weight of from about 2500 to about 3000. This hydrophobic moiety is condensed with propylene oxide to the extent that the condensation product contains from about 40% to about 80% by weight of polyoxyethylene and has a molecular weight of from about 5,000 to about 11,000.

(5) Semi-polar nonionic surfactant detergents include water-soluble amine oxides and phosphine oxides containing one alkyl moiety of from about 10 to 18 carbons and two moieties selected from the group consisting of alkyl groups and hydroxyalkyl groups containing from 1 to about 3 carbon atoms and water-soluble sulfoxides containing one alkyl moiety of from about 10 to 18 carbons and one moiety selected from the group consisting of alkyl groups and hydroxyalkyl groups containing from 1 to about 3 carbon atoms.

Preferably, the surfactant is an anionic surfactant. Most anionic surfactants can be broadly described as the water-soluble salts, particularly the alkali metal, alkaline earth metal, ammonium and amine salts, of organic sulfuric reaction products having in their molecular structure an alkyl radical containing from about 8 to about 22 carbon atoms and a sulfonic acid radical. In particular, the anionic surfactants useful in the present invention are the sulfonates, alkyl sulfates and alkyl ether sulfates having an alkyl chain length of from about 8 to about 18 carbon atoms. Non-limiting examples of anionic surfactants that are suitable for use in the present invention include sodium cocyl isothionates, sodium $C_{14}$–$C_{16}$ olefin sulfonates, sodium dodecylbenzene sulfonate, sodium alkyl naphthalene sulfonate, disodium lauryl sulfosuccinate, dioctyl sodium sulfosuccinate, and di sodium cocamido MEA sulfonate. The alkyl sulfates are the preferred anionic surfactant. In accordance with the most preferred embodiment, the anionic surfactant is sodium lauryl sulfate Amphoteric surfactants may also be used in the present invention. Amphoteric surfactants are those surfactants whose acidic or basic character is pH dependent. Depending on the pH, amphoteric surfactants may behave either as an anionic surfactant, a cationic surfactant, or both. Preferably the amphoteric surfactants are water soluble betaine surfactants. Examples of suitable betaine surfactants are dodecyldimethylammonium acetate, tetradecyldimethylammonium acetate, hexadecyldimethylammonium acetate, alkyldimethylammonium acetate, dodecyldimethylammonium butanoate, tetradecyldimethylammonium butanoate, hexadecyldimethylammonium butanoate, dodecyldimethylammonium hexanoate, tetradecyldiethylainmonium pentanoate, tetradecyldipropylammonium pentanoate, dodecylethylammounium acetate, dodecyldimethylammonium hexanoate, and hexadecyldimethylammonium hexanoate. Preferred amphoteric betaine surfactants include, but are not limited to, lauramidopropyl betaine and cocomido betaine.

The surfactant is preferably present in the tableted household cleaner at a level of up to about 2%. In a preferred embodiment, the amount of surfactant present in the tableted household cleaner ranges from about 0.25% to about 1%. Less than 2% of surfactant is desired so as to minimize streaking. The more surfactant that is present in the cleaner, the more streaking that results.

Other optional ingredients such as lubricants, stabilizing agents, fragrances and dyes may also be included in the tableted household cleaner of the present invention, so long as they do not detract from the advantages resulting from the compositions of the present invention. Lubricants, which prevent the tablet from sticking to the tablet press, can be added in amounts up to about 0.5%. Suitable lubricants include sodium stearyl futmarate, polyethylene glycol and boric acid. Of particular preference is sodium stearyl fumarate, which is available from Mendell, a Penwest Company, of Patterson, N.Y., under the trade name of PRUV.

In a preferred embodiment, the tableted household cleaner of the present invention consists essentially of disodium citrate, potassium bicarbonate and polyvinyl alcohol. According to the most preferred embodiment, the tableted cleaner consists of disodium citrate, potassium bicarbonate, polyvinyl alcohol and 95:5 mixture of potassium bicarbonate and anionic surfactant.

By way of example, the most preferred embodiment of the present invention is a household cleaner in tablet form consisting of the following ingredients:

TABLE I

| Component | Amount (wt. %) |
|---|---|
| Disodium citrate | 65.6 |
| Potassium bicarbonate | 28.2 |
| Polyvinyl alcohol | 5.0 |
| Potassium bicarbonate/sodium lauryl sulfate | 1.0 |
| Sodium stearyl fumarate | 0.2 |

The tableted household cleaner of the present invention can be made by first mixing an acid selected from the group consisting of carboxylic acids, their salts and mixtures thereof, a base selected from the group consisting of alkali metal carbonates, bicarbonates and mixtures thereof and polyvinyl alcohol to form a powdery mixture. In a preferred embodiment, disodium citrate, potassium bicarbonate and polyvinyl alcohol are mixed together to obtain a flowable powder mixture. This free-flowing powder is then fed to a tablet press where the powder is pressed into tablet form. In a more preferred embodiment, sodium lauryl sulfate is also mixed in to obtain a flowable powder mixture that is then molded into tablets. Most preferably, a sodium lauryl sulfate solution is first added to the potassium bicarbonate to form a granulate. The granulate, which contains potassium bicarbonate and sodium lauryl sulfate in a ratio of about 95:5, is formed by adding a solution of sodium lauryl sulfate to the potassium bicarbonate with agitation and then allowing the mixture to dry. This sodium lauryl sulfate and potassium bicarbonate blend is then mixed with the disodium citrate, potassium bicarbonate and polyvinyl alcohol to form a free-flowing powder that is pressed into tablet form.

The tablet may have any suitable size according to manufacturing and consumer preferences. For example, tablets used for cleaning windows and glass generally weigh up to about 5 grams, preferably from about 1 to about 2 grams. Tablets used for cleaning other hard surfaces generally weigh up to about 30 grams, preferably from about 5 to about 10 grams.

The tableted household cleaner of the present invention can be used to clean glass and other hard surfaces such as countertops and floors. The cleaning tablet of the present invention is particularly useful in cleaning hard surfaces in kitchens and bathrooms. Specifically, the cleaninig tablet of the present invention is preferably used to clean such kitchen surfaces as a stove, oven or pots and pans. Moreover, the present invention may be incorporated in other applications, for example a laundry tablet, where it is desirable to have a cleaning tablet that dissolves in a quick and efficient manner.

To use as a glass cleaner, one tablet is placed in a suitable amount of water, generally about 500 milliliters, and allowed to dissolve. The dissolution time is preferably no more than about 2 minutes. After the tablet has dissolved, the resulting solution may be used to clean glass. The solution can be sprayed onto the surface to be cleaned, preferably using a spray bottle. The wet surface is wiped to dryness with a clean paper towel or lint-free cloth for streak-free cleaning. To clean hard surfaces other than glass, one tablet may be dissolved in about 500 milliliters of water, with the dissolution time again being no more than about 2 minutes. When the tablet has dissolved, a cloth or sponge can be immersed in the solution. The excess should be squeezed from the cloth or sponge, and then the surface to be cleaned can be wiped clean using the cloth or sponge. A clean paper towel or lint-free cloth should be used to wipe the surface dry so to prevent streak marks.

The cleaning composition of the present invention may be used to manufacture cleaning tablets for use in a plurality of applications. Non-limiting examples are laundry tablets, bleach tablets, and tablets for creating solutions that can be used to clean windows, counter tops and other hard surfaces. The level of surfactant may be varied according to each application. For example, a lower amount of surfactant would be used in a window cleaner than a counter-top cleaner because a window cannot be rinsed as easily as a counter-top in order to remove the cleaner. A preferred level of surfactant in a window cleaning tablet is from about 0% to about 1%, while a preferred level of surfactant in a counter-top cleaner is from about 1% to about 2%.

Of course, it should be understood that a wide range of changes and modifications can be made to the embodiments described above. It is intended, therefore, that the foregoing description illustrates rather than limits this invention, and that it is the following claims, including all equivalents, that define this invention.

What is claimed is:

1. A cleaning tablet comprising:

a. from about 40% to about 75% of disodium citrate;

b. from about 20% to about 40% of potassium bicarbonate;

c. from about 2% to about 10% of polyvinyl alcohol; and d. from about 0.25% to about 1% of a surfactant; wherein the surfactant is an alkylbetaine.

* * * * *